US007181783B2

(12) United States Patent
O'Reilly

(10) Patent No.: US 7,181,783 B2
(45) Date of Patent: Feb. 27, 2007

(54) MULTI-FUNCTION ROOM FURNISHING SYSTEM HAVING ARTICULATING SEPARABLE COMPONENTS

(76) Inventor: Erin M. O'Reilly, 325 S. Maryland Pkwy., Las Vegas, NV (US) 89101-5300

( * ) Notice: Subject to any disclaimer, the term of this patent is extended or adjusted under 35 U.S.C. 154(b) by 0 days.

(21) Appl. No.: 11/363,566

(22) Filed: Feb. 28, 2006

(65) Prior Publication Data

US 2006/0191069 A1 Aug. 31, 2006

Related U.S. Application Data

(63) Continuation-in-part of application No. 10/794,212, filed on Mar. 5, 2004, now abandoned.

(60) Provisional application No. 60/452,626, filed on Mar. 6, 2003.

(51) Int. Cl.
*A47B 85/04* (2006.01)
*A47C 17/16* (2006.01)
*A47C 19/22* (2006.01)

(52) U.S. Cl. ..... 5/3; 297/440.14

(58) Field of Classification Search ..... 5/2.1, 5/12.1, 53.1, 59.1, 58, 308, 400, 488
See application file for complete search history.

(56) References Cited

U.S. PATENT DOCUMENTS 2,087,574 A * 7/1937 Moses ..... 297/113
2,620,488 A * 12/1952 Woller ..... 5/21
2,793,685 A * 5/1957 Pitz ..... 297/411.27
2,852,787 A * 9/1958 Forest ..... 5/2.1
3,316,564 A * 5/1967 Rogers, Jr. ..... 5/9.1
3,350,725 A * 11/1967 Fasanella ..... 5/12.1
3,635,521 A * 1/1972 Shivvers ..... 297/125
3,710,403 A * 1/1973 Weidner et al. ..... 5/18.1
3,733,624 A * 5/1973 Trabin ..... 5/58
3,811,728 A * 5/1974 Redemske ..... 297/440.14
3,890,658 A * 6/1975 Petersillie ..... 5/2.1
3,952,342 A * 4/1976 Hart ..... 5/2.1
4,070,715 A * 1/1978 Reppas ..... 5/2.1
4,110,854 A * 9/1978 Sjolie ..... 5/2.1
4,220,984 A * 9/1980 Truher et al. ..... 362/130
4,259,755 A * 4/1981 Hollander ..... 5/58
4,742,437 A * 5/1988 Downey ..... 5/666
5,134,737 A * 8/1992 Wyman ..... 5/600

(Continued)

FOREIGN PATENT DOCUMENTS

AT 142520 * 8/1935 ..... 5/2.1

(Continued)

*Primary Examiner*—Robert Canfield
*Assistant Examiner*—Gay Ann Spahn
(74) *Attorney, Agent, or Firm*—Polster, Lieder, Woodruff & Lucchesi, L.C.

(57) ABSTRACT

An articulated furnishing system consisting of a reconfigurable mattress and a foundation composed of multiple separable components. The articulated furnishing system is adaptable between a bed configuration, a seating area configuration, and a work surface configuration through rearrangement and re-orientation of the multiple separable components. A light box associated with the foundation is configured with one or more light sources to provide illumination, and to provide one or more surfaces adapted for article storage.

11 Claims, 8 Drawing Sheets

U.S. PATENT DOCUMENTS

| | | | | | |
|---|---|---|---|---|---|
| 5,280,656 | A * | 1/1994 | Gossett | 5/2.1 |
| 5,483,708 | A * | 1/1996 | Binfare' | 5/12.1 |
| 5,522,097 | A * | 6/1996 | Ciccotelli | 5/37.1 |
| 5,566,409 | A * | 10/1996 | Klearman | 5/723 |
| 5,681,090 | A * | 10/1997 | St. Thomas | 297/440.14 |
| 5,683,169 | A * | 11/1997 | Lucas et al. | 362/130 |
| 5,765,239 | A * | 6/1998 | Moses | 5/2.1 |
| 5,867,849 | A * | 2/1999 | Pontrello | 5/2.1 |
| 6,234,642 | B1 * | 5/2001 | Bokamper | 362/130 |
| 6,256,811 | B1 * | 7/2001 | Nelson | 5/53.1 |
| 6,519,795 | B1 * | 2/2003 | Liu | 5/617 |
| 6,568,001 | B2 * | 5/2003 | Walsh | 5/2.1 |
| 6,675,408 | B1 * | 1/2004 | Mason | 5/2.1 |
| 6,824,220 | B1 * | 11/2004 | Davison | 297/440.14 |
| 2004/0055086 | A1 * | 3/2004 | Owens, Jr. et al. | 5/202 |

FOREIGN PATENT DOCUMENTS

| | | | | |
|---|---|---|---|---|
| AT | 181928 | * | 5/1955 | 5/2.1 |
| CA | 595253 | * | 3/1963 | 5/2.1 |
| CH | 135439 | * | 12/1929 | 5/2.1 |
| CH | 307925 | * | 9/1955 | 5/2.1 |
| CH | 407449 | * | 8/1966 | 5/2.1 |
| DE | 3722145 | * | 2/1988 | 5/2.1 |
| DE | 3723926 | A1 * | 2/1988 | |
| FR | 1487312 | * | 7/1967 | 5/2.1 |
| FR | 2188429 | * | 1/1974 | 5/2.1 |
| FR | 2395001 | * | 1/1979 | 5/2.1 |
| FR | 2519533 | * | 7/1983 | 5/2.1 |
| GB | 2107977 | * | 5/1983 | 5/2.1 |
| NO | 99173 | * | 12/1961 | 5/2.1 |

* cited by examiner

MULTI-FUNCTION ROOM FURNISHING SYSTEM HAVING ARTICULATING SEPARABLE COMPONENTS

CROSS-REFERENCE TO RELATED APPLICATIONS

This application is a continuation-in-part application of U.S. patent application Ser. No. 10/794,212 filed Mar. 5, 2004 now abandoned, hereby incorporated by reference, which claims the benefit of U.S. Provisional Patent Application No. 60/452,626 filed Mar. 6, 2003, hereby incorporated by reference.

STATEMENT REGARDING FEDERALLY SPONSORED RESEARCH

Not Applicable.

BACKGROUND OF THE INVENTION

The present invention is related to multi-functional room furnishings, and in particular, to an articulated furnishing system suitable for use in a hotel room, which includes a multifunctional unit including separable components configurable for sleeping, working, and relaxing.

SUMMARY OF THE INVENTION

Briefly stated, in a first embodiment of the present invention an articulated furnishing system includes a reconfigurable mattress and a foundation, which is composed of multiple separable components. The articulated furnishing system is adaptable between a bed configuration, a seating area configuration, and a work surface configuration through re-orientation and re-arrangement of the multiple separable components. A light box associated with the foundation is configured with one or more light sources to provide illumination, and provides surfaces adapted for storage.

In an alternate embodiment of the invention, the above-described furnishing system further comprises a retractable duvet cover. The duvet cover includes at least one channel, which runs from one end of the cover to the other end. The channel has a distal end and a proximal end. A string is attached to the distal end of the at least one channel, and lies within the channel. The string is of a length sufficient to extend beyond the proximal end of the channel to allow the user access thereto.

The foregoing and other features, and advantages of the invention as well as embodiments thereof will become more apparent from the reading of the following description in connection with the accompanying drawings.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
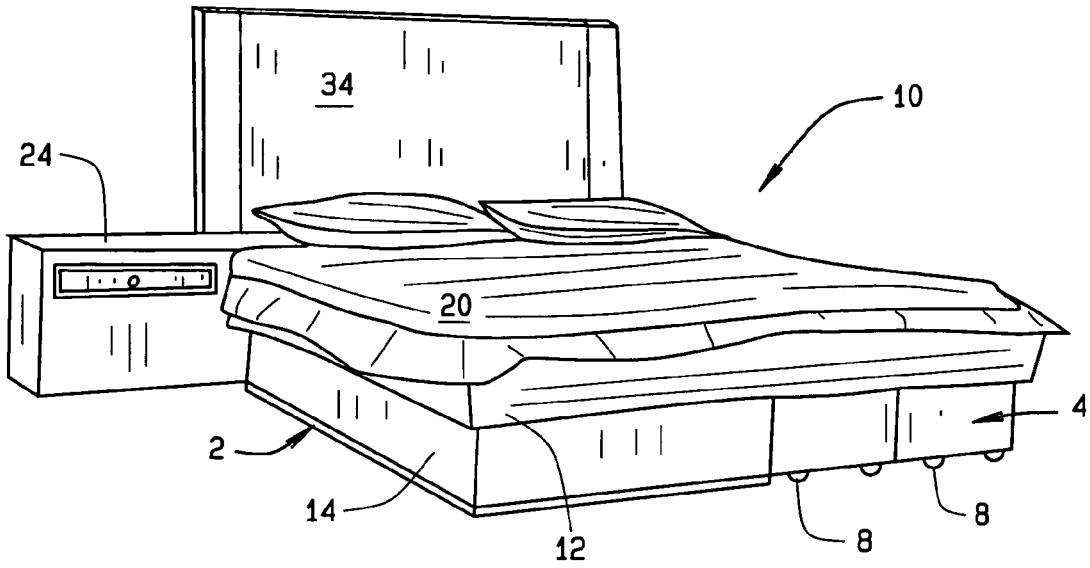
FIG. 1 is an off-axis perspective view of the first embodiment of the articulated furnishing system of the present invention.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 4:
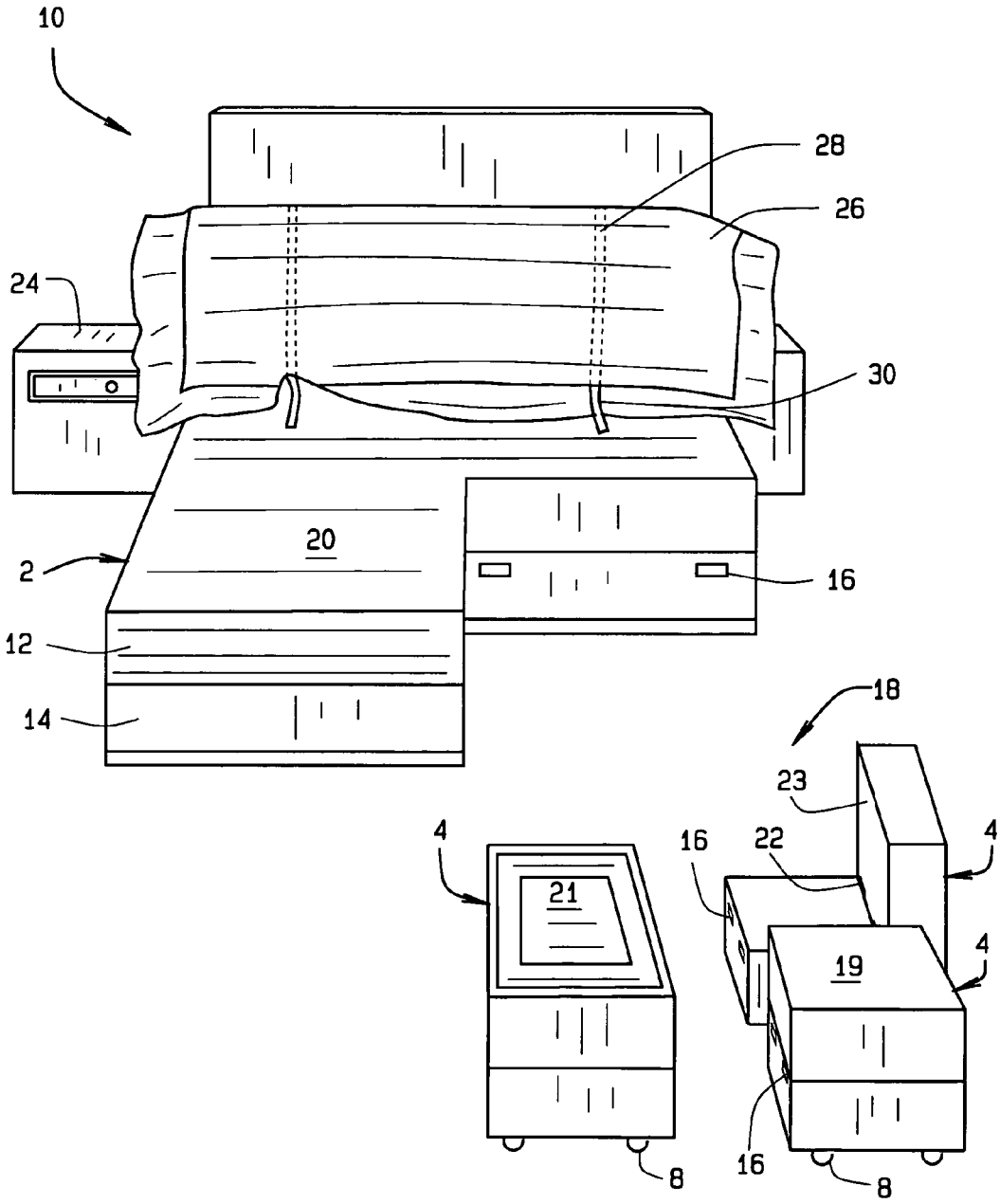
FIG. 4 is a front perspective view of the articulated furnishing system of FIG. 1, configured for seating.

Turning to FIGS. 1–10, the articulated furnishing system of the present invention is shown generally as 10 and comprises a base unit 2 and a plurality of separable components 4. The base unit 2 has a fixed configuration. The separable components 4 are each adapted for operative association with the foot of the base unit 2 in multiple configurations, including at least a first configuration (FIGS. 1 and 2) and a second configuration (FIG. 4).

Figure 2:
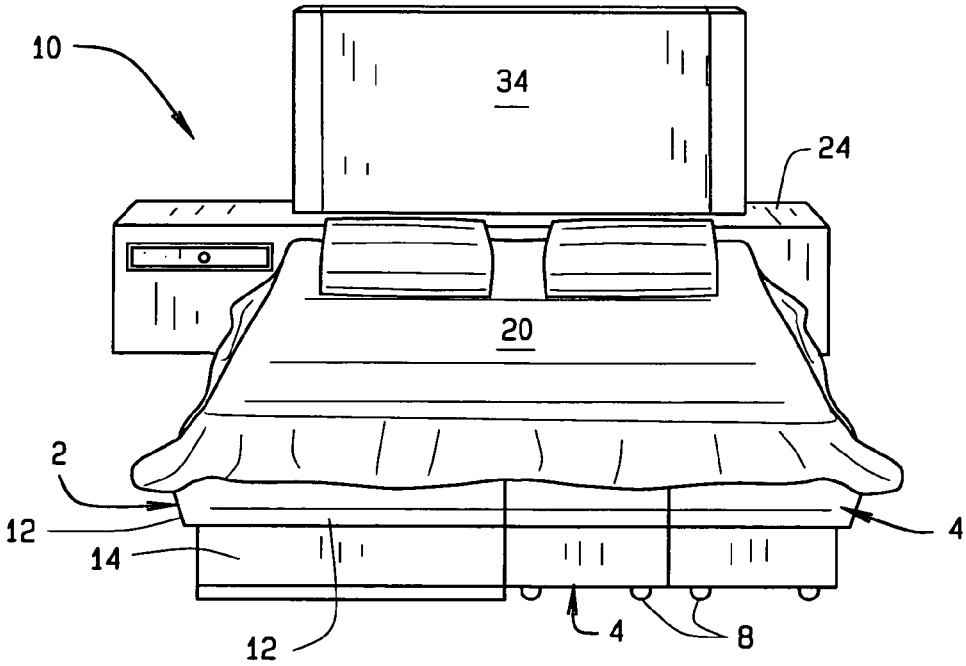
FIG. 2 is a front perspective view of the articulated furnishing system of FIG. 1.
Figure 3:
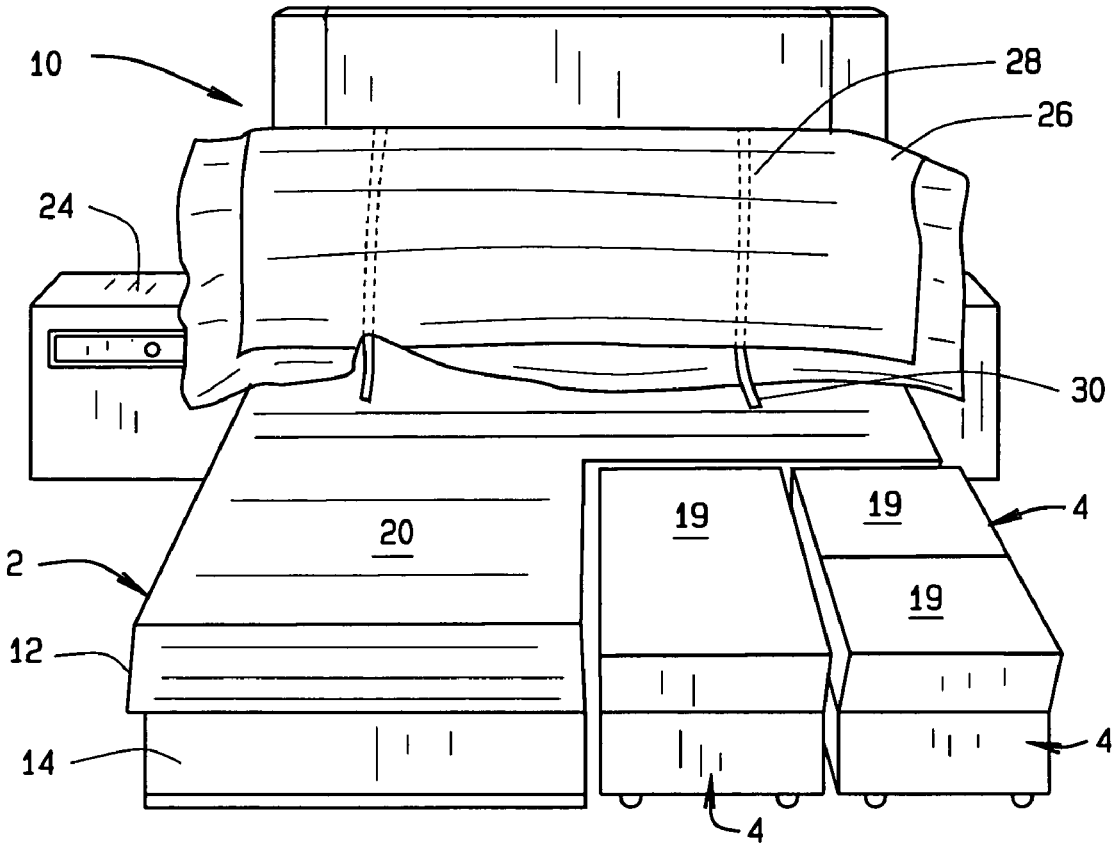
FIG. 3 is a front perspective view of the articulated furnishing system of FIG. 1 configured for re-arrangement.

Generally, the system 10 in a first configuration is a bed having a sleeping surface 20 (FIGS. 1 and 2). However, the system 10 is adapted to transform using a configurable mattress 12 and foundation 14. The configurable mattress 12 and foundation 14 can separate out three separable components 4, which preferably roll out from the base unit 2 to arrange in a second configuration (FIG. 4). In the depicted embodiment, the separable components 4 comprise casters 8, which aid in moving components 4 about. In the second configuration, the base unit 2 can act like a chaise lounge and a sofa. In addition, the base unit 2 may include a duvet 26 that acts like a bolster or backrest, which is described in further detail below. The three smaller separable components 4 roll out on casters 8 in such a way that they may form a seating area 18 with seating surfaces 19. Those skilled in the art will recognize that the seating area 18 can be configured in multiple arrangements to meet the user's needs and wants. For example, the separable components 4 can be flipped over or otherwise configured to reveal hard surfaces 21 that can be used as a work surface or a table surface. In addition, the separable components 4 can pivot using hinges 22 to a substantially vertical orientation to act as a backrest 23. In addition, the base unit 2 can be removably connected to the separate components 4 by magnets 16.

Those skilled in the art will recognize that the separable components can be arranged to have any number of configurations. For example, in another embodiment all the separable components 4 can comprise seating surfaces 19. In another embodiment, all the separable components 4 can comprise table surfaces 21. In yet another embodiment, the separable components 4 are adapted to provide a plurality of sleeping surfaces. In yet another embodiment, the separable components 4 can pivot using hinges 22 to a substantially vertical orientation to reveal a storage unit.

The system 10 further includes at least one shelf surface 24 coupled to the foundation 14, which is disposed in operative relation to the sleeping cushion 12. The shelf surface 24 is adapted generally to hold accessories.

In a further embodiment of the invention (FIGS. 5–10), the system 10 includes a lightbox 34 having at least one illumination source 6 coupled to the foundation 14, which is disposed in operative relation to the sleeping cushion 12. The illumination source 6 will provide enough light so that no other lamps will be needed.

Figure 5:
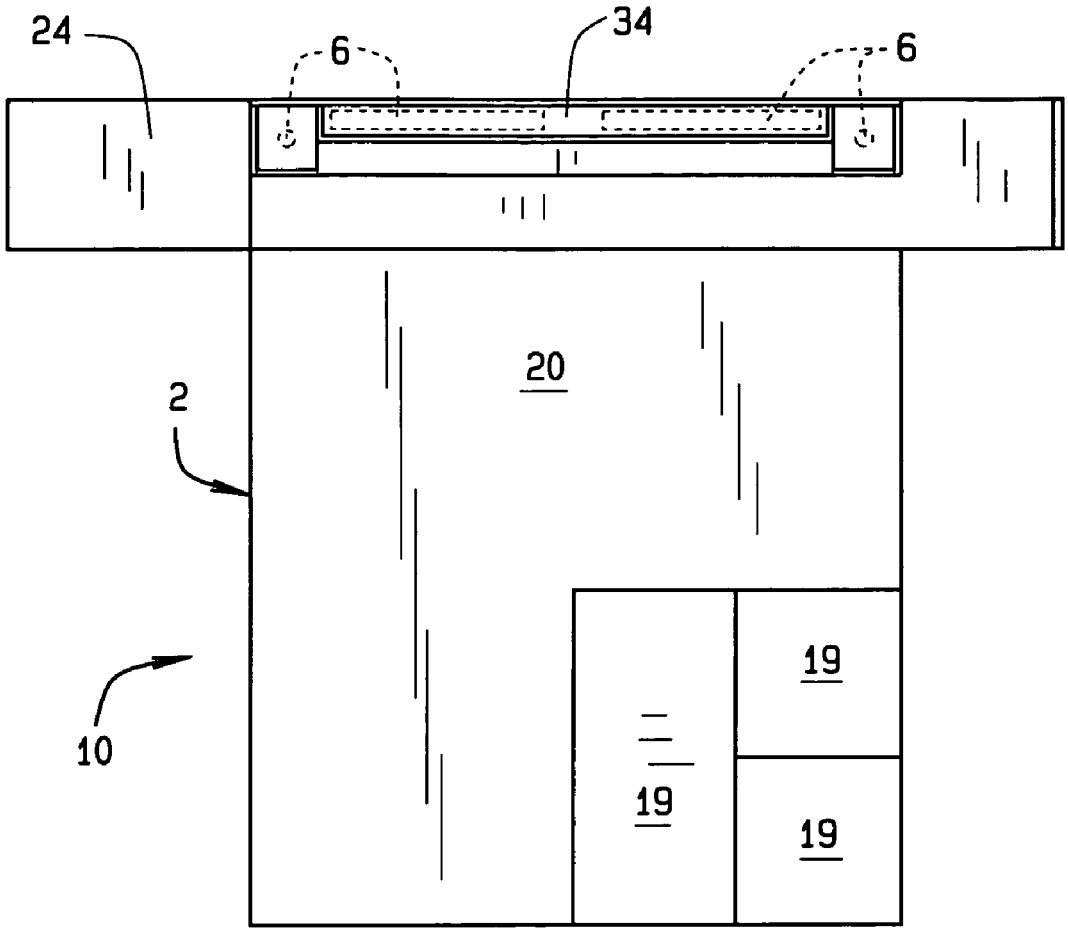
FIG. 5 is a top plan view of the articulated furnishing system of FIG. 1.
Figure 6:
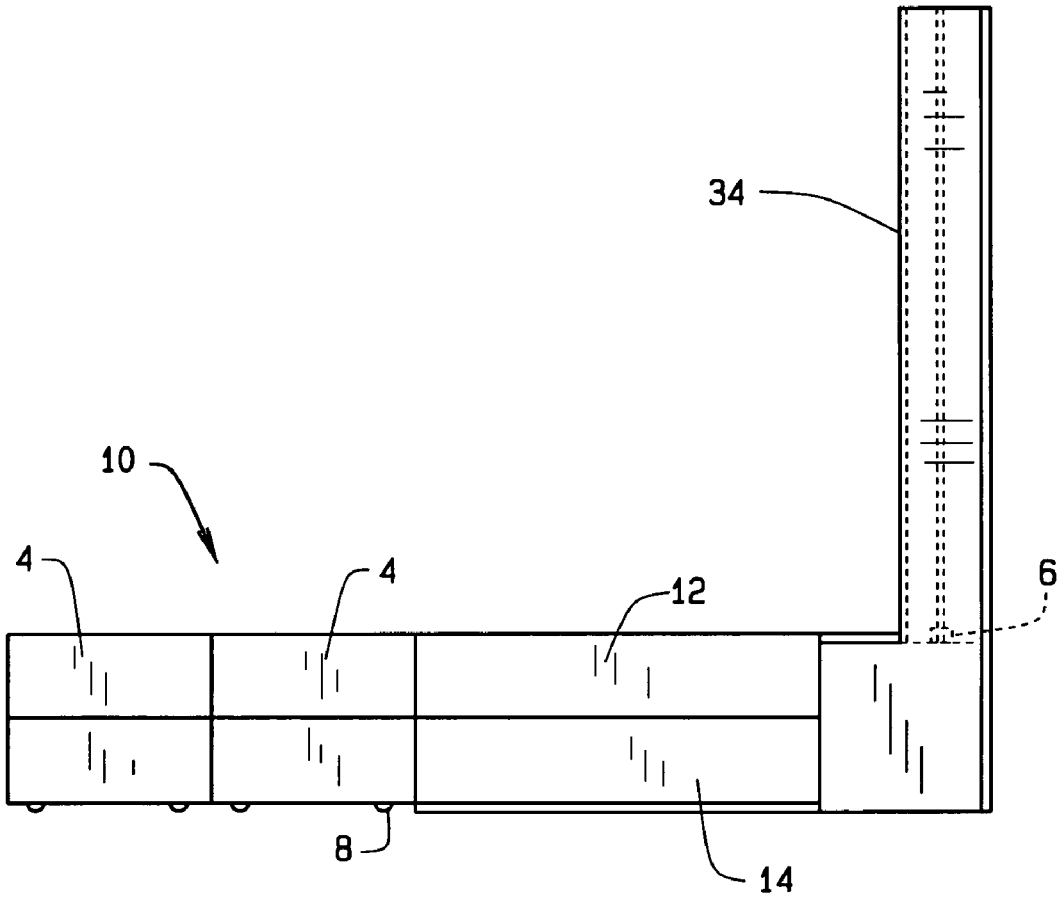
FIG. 6 is a right plan view of the articulated furnishing system of FIG. 1.
Figure 7:
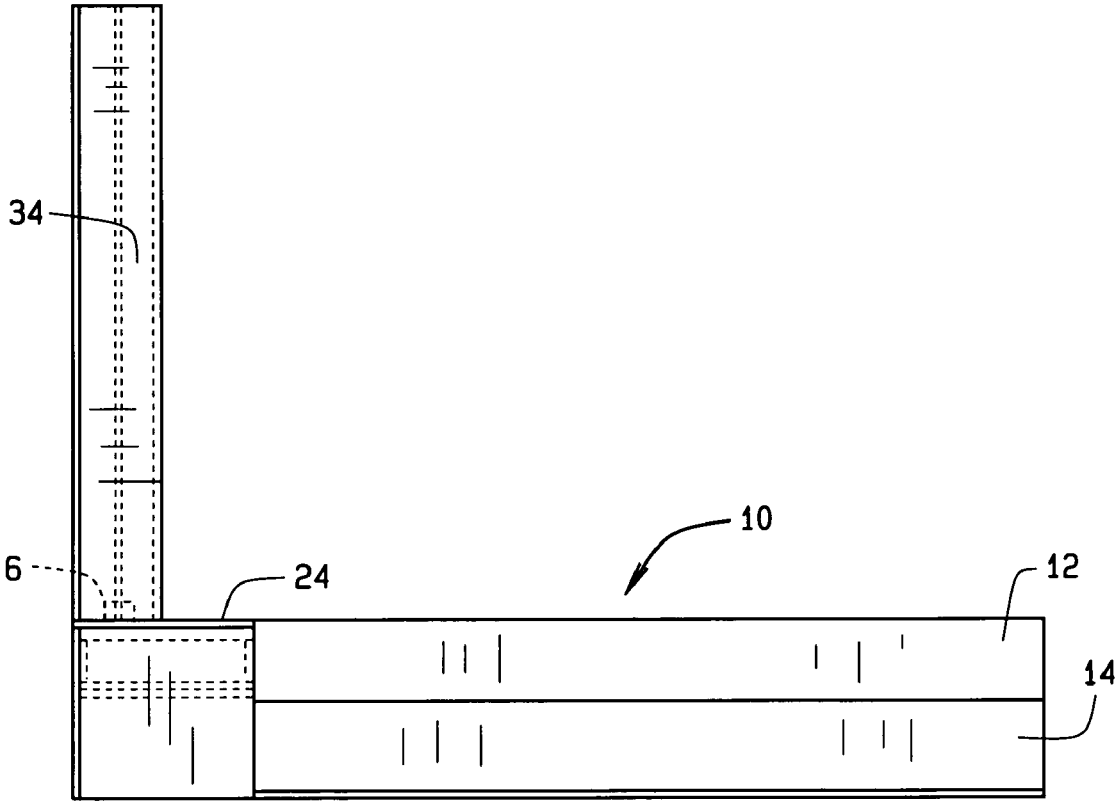
FIG. 7 is a left plan view of the articulated furnishing system of FIG. 1.
Figure 8:
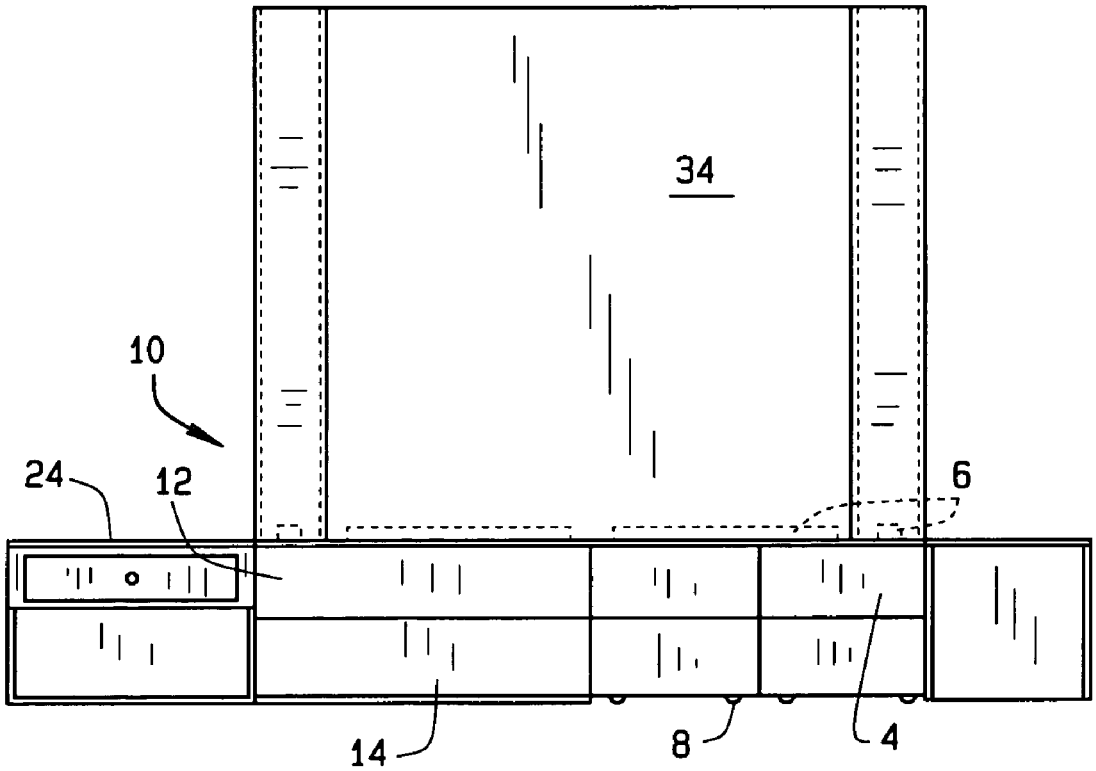
FIG. 8 is a front plan view of the articulated furnishing system of FIG. 1.
Figure 9:
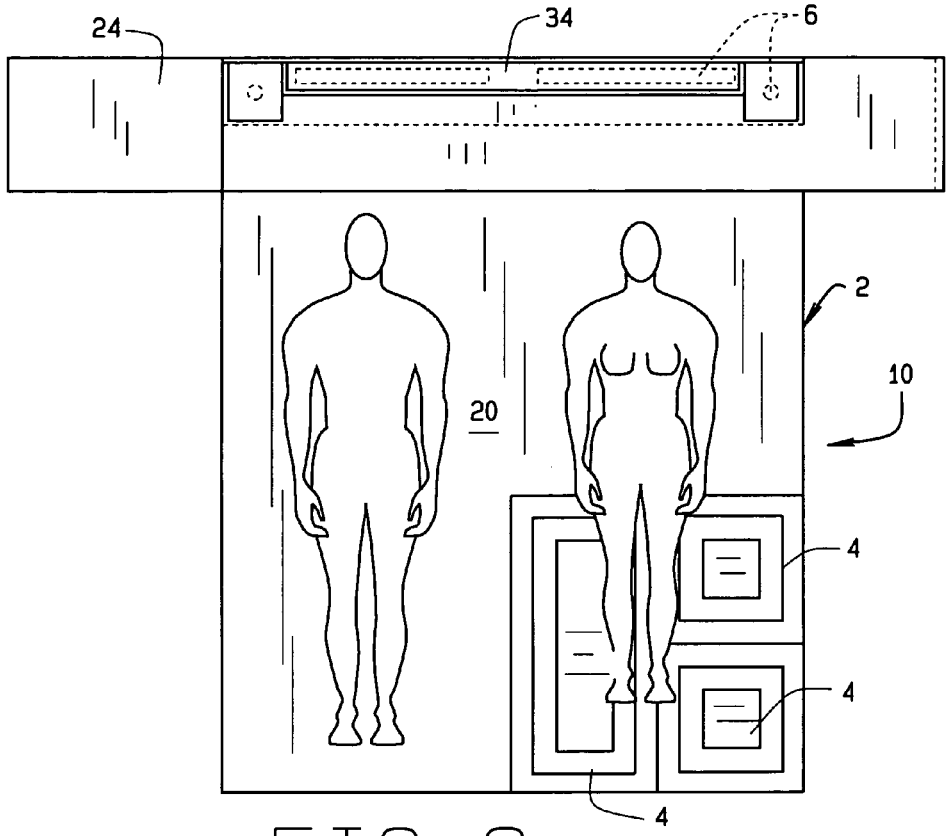
FIG. 9 is a top plan view of the articulated furnishing system of FIG. 1, illustrating occupant sleeping arrangements.
Figure 10:
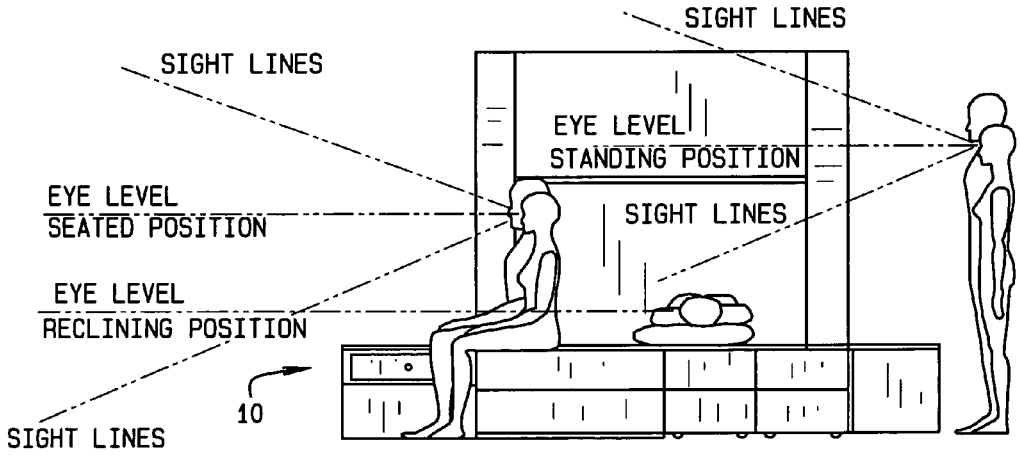
FIG. 10 is a front plan view of the articulated furnishing system of FIG. 1, illustrating sight lines for various configurations.

As mentioned above, the system 10 includes a duvet cover 26, which can be retracted similarly to a roman blind or shade, as shown in FIGS. 4–5. The duvet cover 26 comprises at least one channel 28 therethrough, which runs from one end of the cover to the other end. In the depicted embodiment there are two channels, but there may be more. The channels 28 are adapted to allow a string 30 or similar device to lie therein. The channels 28 have a distal end, which is away from the user and a proximal end, which is closer to the user. The string 30 is generally longer than the channels 28 and should be connected to the distal end of the channel one end. The string 30 should extend out of the proximal end of the channel 28 to allow the user access thereto. When a user desires to retract the comforter, the strings 30 are pulled and the duvet cover 26 retracts toward the user who is pulling the strings 30, thereby retracting the cover 26. The retractable duvet cover 26 may be used with the system 10 of the invention, or without the system 10.

Those of ordinary skill in the art will recognize that the present invention is not limited to the configuration and dimensions of the first embodiment shown in the various Figures. In alternate embodiments, components of the articulated furnishing system of the present invention may be adapted for arrangement in different configurations and corresponding dimensions. Similarly, the number of multiple separable components 4 may be varied from that shown in the various Figures as required to accommodate greater or lesser numbers of anticipated occupants.

Changes can be made in the above constructions without departing from the scope of the invention, it is intended that all matter contained in the above description or shown in the accompanying drawings shall be interpreted as illustrative and not in a limiting sense.

What is claimed is:

1. A multifunction room furnishing system comprising:

a non-folding base unit having a fixed configuration;

a plurality of separable components, each of said plurality of separable components adapted for operative association with said base unit in a first configuration, and for operative association with said base unit in at least a second configuration, wherein said first configuration differs from said second configuration;

wherein the separable components are operatively associated with the base unit generally at a foot of the base unit and are detachable from the base unit to provide a plurality of functions;

wherein at least one of the plurality of separable components includes a top portion and a bottom portion, wherein the top portion is capable of pivoting between a substantially horizontal orientation and a substantially vertical orientation relative to the bottom portion to provide a seat and a backrest for said at least one separable component;

wherein the base unit and the separable components are connected by magnets; a sleeping cushion positioned on said base unit;

a lightbox coupled with the base unit and disposed in operative relation to said sleeping cushion; and at least one illumination source disposed within the lightbox.

2. The multifunction room furnishing system of claim 1 wherein said first configuration is adapted to provide at least one sleeping surface.

3. The multifunction room furnishing system of claim 1 wherein said second configuration is adapted to provide a plurality of seating surfaces.

4. The multifunction room furnishing system of claim 1 wherein said second configuration is adapted to provide at least one table surface.

5. The multifunction room furnishing system of claim 1 wherein at least one of the plurality of separable components includes a storage unit.

6. The multifunction room furnishing system of claim 1, further comprising a retractable duvet cover, the duvet cover comprising:

at least one channel, which runs from one end of the cover to the other end, the at least one channel having a distal end and a proximal end; and a string positioned within the channel and attached to the distal end of the at least one channel, wherein the string is of a length sufficient to extend beyond the proximal end of the channel to allow the user access thereto.

7. The multifunction room furnishing system of claim 6, further including magnets inset into the base unit and the at least one separable component, the magnets being capable of securing the at least one separable component to the base unit.

8. A multifunction furnishing system comprising:

a base unit having a foundation, and a sleeping cushion disposed on said foundation, at least one separable foundation component operatively associated with the base unit;

magnets inset into the base unit and the at least one separable foundation component, the magnets being capable of removably securing the at least one separable foundation component to the foundation; and wherein said at least one separable foundation component is configured as a seating surface;

wherein said at least one separable foundation component includes a top portion and a bottom portion, wherein the top portion is capable of pivoting between a substantially horizontal orientation and a substantially vertical orientation relative to the bottom portion to provide a seat and a backrest for said at least one separable foundation component;

a lightbox coupled to said base unit and disposed in operative relation to said sleeping cushion, said lightbox having at least one illumination source disposed within the lightbox; and wherein said base unit has a head end and a foot end and the at least one separable foundation component is operatively associated generally with said foot end of the base unit.

9. The multifunction furnishing system of claim 8, wherein said at least one separable foundation component, has first and second configurations, said first configuration having a seating surface and said second configuration having a table surface.

10. The multifunction furnishing system of claim 8, further including at least one shelf surface coupled to said foundation, said shelf surface disposed in operative relation to said sleeping cushion.

11. A multifunction furnishing system comprising:

a base unit having a foundation, and a sleeping cushion disposed on said foundation, said base unit having a head end and a foot end;

a plurality of separable foundation components operatively associated with the foot end of the base unit;

magnets inset into the base unit and the plurality of separable foundation components, the magnets being capable of removably securing the plurality of separable foundation components to the base unit;

wherein at least of the plurality of separable foundation components is capable of being configured as a seating surface;

wherein said at least one separable foundation component is capable of being configured as a table surface;

at least one shelf surface coupled to said base unit, said shelf surface disposed in operative relation to said sleeping cushion;

a lightbox coupled with the base unit and disposed in operative relation to said sleeping cushion;

at least one illumination source disposed within the lightbox;

wherein the at least one of the plurality of separable foundation components is capable of pivoting between a substantially horizontal orientation and a substantially vertical orientation to provide a seat and a backrest for said at least one separable foundation component;

wherein the at least one of the plurality of separable foundation components includes a storage unit;

a retractable duvet cover comprising:

at least one channel, which runs from one end of the cover to the other end, the at least one channel having a distal end and a proximal end; and a string positioned within the channel and attached to the distal end of the at least one channel, wherein the string is of a length sufficient to extend beyond the proximal end of the channel to allow the user access thereto.

* * * * *